US005390449A

United States Patent [19]

Hilton

[11] Patent Number: 5,390,449

[45] Date of Patent: Feb. 21, 1995

[54] ROTARY SANDING APPARATUS

[76] Inventor: Harry Hilton, R.R. #2, Box 156, Wiscasset, Me. 04078

[21] Appl. No.: 161,415

[22] Filed: Dec. 6, 1993

[51] Int. Cl.[6] ..... B24D 13/14

[52] U.S. Cl. ..... 451/526; 451/490; 451/508; 451/538; 451/539

[58] Field of Search ..... 51/358, 362, 394, 406, 51/407, 376, 382, 384, 398, 54, 109 R, 395, 396

[56] References Cited

U.S. PATENT DOCUMENTS

| | | | |
|---|---|---|---|
| 3,707,059 | 12/1972 | Burtch et al. | 51/358 |
| 4,222,204 | 9/1980 | Benner | 51/376 |
| 4,558,542 | 12/1985 | Marton | 51/358 |
| 5,297,366 | 3/1994 | Huddleston | 51/376 |

*Primary Examiner*—Bruce M. Kisliuk
*Assistant Examiner*—Eileen P. Morgan
*Attorney, Agent, or Firm*—Frederick R. Cantor

[57] ABSTRACT

A rotary sanding apparatus, includes a circular support plate having a relatively deformable circular ring extending from its front face to form an annular container and reinforcement for a resilient deformable foam pad. The front face of the pad is essentially coplanar with the front edge face of the circular ring, so that an abrasive disk can lie flat against the pad front face, with its outer edge area secured to the circular ring. The circular ring acts as a confinement device for preventing the foam pad from being torn apart by pressure engagement of irregular surfaces against the abrasive disk material.

2 Claims, 1 Drawing Sheet

ROTARY SANDING APPARATUS

BACKGROUND OF THE PRESENT INVENTION

The present invention relates to a rotary sanding apparatus.

The present invention, more particularly, relates to a rotary sanding apparatus, that can be driven by an electric motor to perform a sanding operation.. The apparatus comprises a circular support plate having a hub structure extending from its rear face for mounting the apparatus on a portable drilling machine, or similar rotary power device. A resilient deformable pad is secured to the front face of the support plate to form a mounting surface for a circular abrasive disk.

The resilient deformable pad is formed of a foamed plastic material, e.g. polyurethane foam, to a thickness of about one inch, whereby the abrasive disk can conform to irregular contours on the work piece. The aim is to facilitate sanding operations on non-flat work surfaces, i.e. surfaces having concave or convex contours.

The use of foamed plastic pads in rotary sanding apparatus is already known. U.S. Pat. No. 3,924,362, issued to H. McAleer on Dec. 9, 1975, shows a foamed pad that includes a soft foam core, and a somewhat harder (or more rigid) outer foam layer bonded to the front face of the foam core. As shown in FIG. 2 of the McAleer patent drawings, the outer foam layer extends around the outer edge of the foam core to form an edge covering. McAleer indicates that the outer foam layer is semi-rigid and relatively tough, to provide better wear and durability than the soft foam core alone. McAleer further indicates that the durability is achieved without sacrificing overall flexibility or resilience, e.g., see column 3, line 20, of the patent. McAleer also indicates that the hard outer foam layer assists in minimizing high speed distortion of the pad so as to permit the use of a larger diameter pad for a given rotational speed.

The present invention seeks to provide a foam pad reinforcing action by a different mechanism than that used by McAleer.

SUMMARY OF THE PRESENT INVENTION

An object of the present invention is to provide a rotary sanding apparatus.

A more particular object of the present invention is to provide a rotary sanding apparatus, that can be driven by an electric motor to perform a sanding operation.

The present invention concerns a rotary sanding pad formed out of a foamed elastomer on the front surface of a relatively rigid support plate. The foamed elastomer is contained within a relatively rigid circular ring extending from the front surface of the support plate, such that the circular ring acts as a reinforcement device and containment for the foam material. The circular ring can be formed of a solid elastomeric material having a higher hardness than the foamed elastomer. The abrasive sanding disk can be secured to the front face of the circular reinforcement ring.

The solid elastomeric ring can stretch and distort in response to pressure generated by irregular work surfaces; therefore the resilient pad can resiliently change shape to conform to various work surface contours. However, the solid elastomeric ring has greater tensile strength and coherence than the foamed elastomer, so that the ring maintains its structural integrity even when highly distorted and stretched.

A BRIEF DESCRIPTION OF THE DRAWINGS

DESCRIPTION OF THE PREFERRED EMBODIMENTS OF THE PRESENT INVENTION

Figure 1:
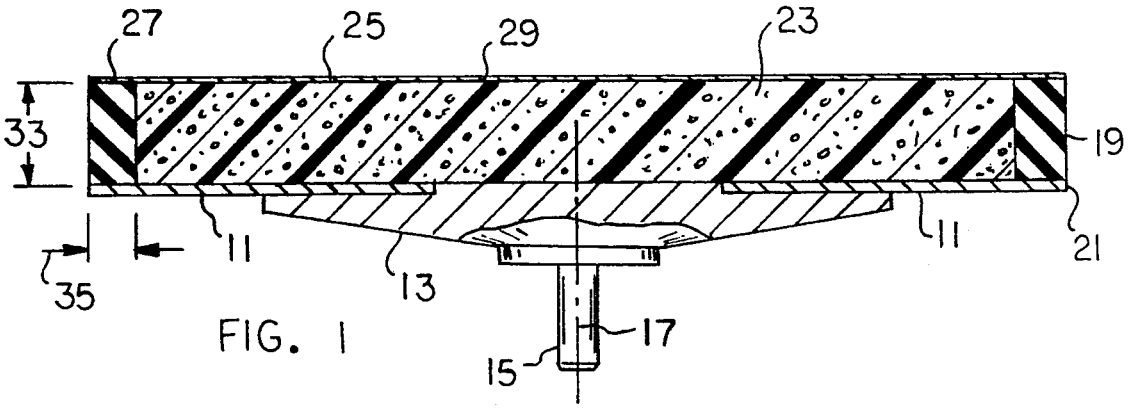
FIG. 1, is a sectional, view taken through a rotary sanding apparatus, embodying the present invention.

FIG. 1, is a sectional view taken through a rotary sanding apparatus embodying the present invention.

FIG. 1, shows a rotary sanding device, that comprises a circular support plate 11, suitably secured to a central hub structure 13. The hub structure 13, includes a shaft 15, that can be fitted into the chuck of a conventional drilling machine, or similar power device, not shown. The rotary sanding device is thereby adapted to be rotated around the central axis 17.

A relatively deformable reinforcement circular ring 19, extends from support plate 11, near its outer circular edge 21, to encircle a foam pad 23. Foam pad 23, completely fills the space circumscribed by ring 19, so that the circular ring 19, forms a containment device for the foam pad 23. The foam pad 23, is preferably formed out of a polyurethane foam material, to an axial thickness of about one inch. The front surface 25, of the foam pad 23, is essentially coplanar with the front annular surface 27, of ring 19, whereby a flat abrasive disk 29, can be adhesively attached to ring surface 27, without distorting the abrasive disk material.

Figure 2:
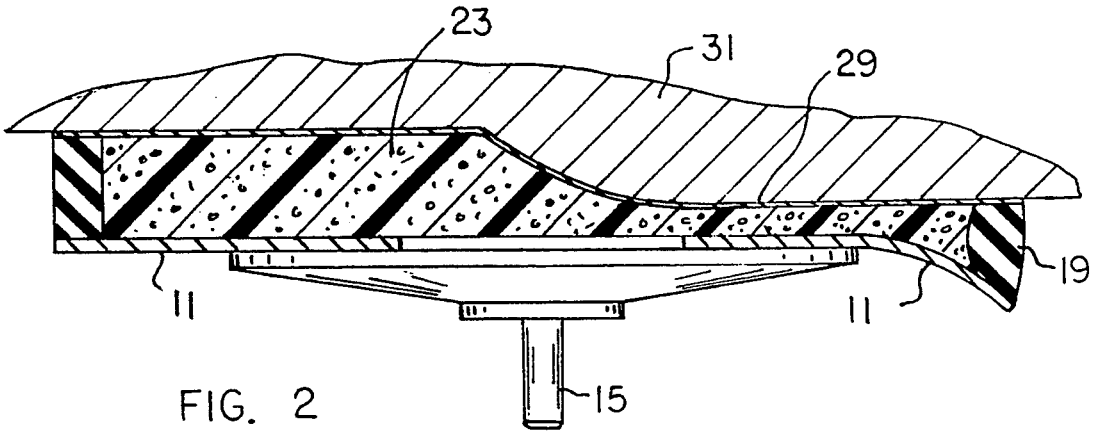
FIG. 2, is a view, taken in the same direction as FIG. 1, but showing the sanding pad distorted by the action of the work surface on the sanding disk.

FIG. 2, is a view, taken in the same direction as FIG. 1, but showing the sanding pad distorted by the action of the work surface on the sanding disk.

Figure 3:
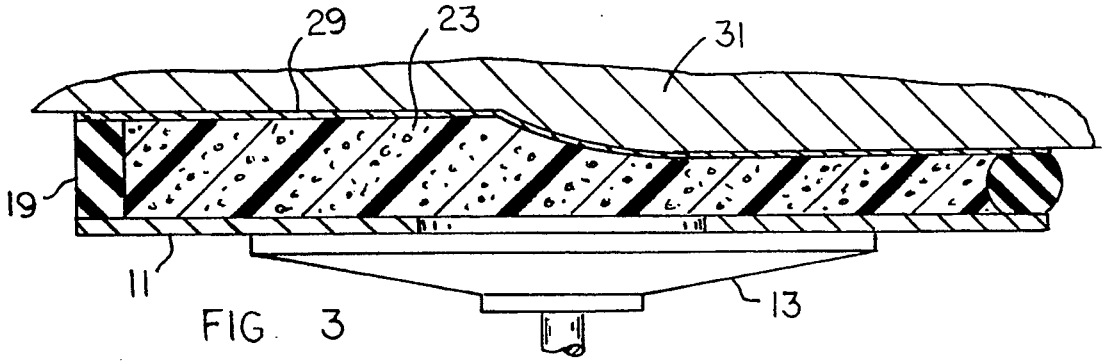
FIG. 3, is a view, taken in the same direction as FIG. 2, but illustrating another embodiment of the present invention.

FIG. 3, is a view, taken in the same direction as FIG. 2, but illustrating another embodiment of the present invention.

Support plate 11, can be a deflectable resilient material, as shown in FIG. 2. Alternately, support plate 11, can be a rigid, non-deflectable material, as shown in FIG. 3. For example, the FIG. 2, support plate 11, can be formed of spring steel, or a high durometer elastomer, whereby outer edge areas of the support plate 11, are deflectable under load forces. The FIG. 3 support plate 11, can be a relatively thick steel plate, that remains rigid under load forces.

When the sanding device is rotated and brought into pressure engagement with an irregular surface on a workpiece 31, the reinforcement ring 19, and foam pad 23, will be deformed, as shown pictorially in FIGS. 2 and 3. Depending on the contour of the workpiece, there may be some slight circumferential stretching of reinforcement circular ring 19, and also some compressing of ring 19. The rotary frictional contact between the abrasive disk 29, and the workpiece 31, will produce a shearing force that will be absorbed by the abrasive disk 29 material, and its adhesive connection with ring 19. There may also be some slight torsional strain of the ring 19 material.

The principal advantageous feature of ring 19, is that the ring 19 has a hoop stress-absorbing function, that contains, or confines, foam pad 23, against radial collapse and escape. Without ring 19, the foam pad 23, would tend to be squeezed excessively and torn apart.

Ring 19, forms a container for the foam pad 23 material, thus preventing the foam material from being torn apart.

It will be appreciated that during powered rotation of the sanding apparatus around axis 17, the foam pad 23 material is continually changing shape. The distortion of the foam pad material, as depicted in FIGS. 2 and 3, travels around axis 17 in a cyclic wave pattern. The pad material is continuously undergoing contraction and expansion so as to be subject to fatigue and cracking that can lead to disintegration, or tearing apart of the foam material. Ring 19, is likewise subject to the cyclic load force, but it is more resistant to such forces.

In the preferred practice of the present invention, the axial thickness dimension 33 of ring 19, is greater than the radial thickness dimension 35 of ring 19, (i.e., the distance between the inner and outer annular surfaces of the ring). Dimension 35, should be sufficient for containment of the foam pad 23, without preventing the ring 19, from compressing axially, or stretching slightly, to absorb the load forces.

Ring 19, is formed of a solid deformable stretchable material having a higher hardness and tensile strength than the foam pad 23, such that ring 19 is relatively rigid when compared to the resilient deformable foam pad 23. The hardness, i.e., durometer, of ring 19, is appreciably higher than that of the foam pad 23, so that the ring 19, acts as a container and reinforcement for the pad 23. Ring 19, has a rectangular cross-section as viewed in FIG. 1.

The present invention describes a Rotary Sanding Apparatus. Features of the present invention are recited in the appended claims. The drawings contained herein necessarily depict structural features and embodiments of the Rotary Sanding Apparatus, useful in the practice of the present invention.

However, it will be appreciated by those skilled in the arts pertaining thereto, that the present invention can be practiced in various alternate forms and configurations. Further, the previous detailed descriptions of the preferred embodiments of the present invention, are presented for purposes of clarity of understanding only, and no unnecessary limitations should be implied therefrom.

Finally, all appropriate mechanical and functional equivalents to the above, which may be obvious to those skilled in the arts pertaining thereto, are considered to be encompassed within the claims of the present invention.

What is claimed is:

1. A rotary sanding apparatus comprising:
- a circular support plate having a rotational axis;
- said support plate having a front face, a rear face and a circular outer edge;
- a hub structure extending from the rear face of said support plate for rotatably mounting the plate on a rotary power device;
- a circular reinforcement ring carried by said support plate at the plate outer edge;
- said ring being concentric around the plate rotational axis;
- said ring projecting forwardly from the front face of the support plate;
- said ring having a front annular surface spaced forwardly from the front face of the support plate;
- said circular ring having an outer diameter and an inner diameter;
- a resilient deformable foam pad secured to the front face of the support plate;
- said foam pad completely filling the space circumscribed by said circular ring;
- said foam pad having a front surface that is coplanar with the front surface of said circular ring;
- a circular abrasive disk having a diameter that is the same as the outer diameter of said circular ring;
- means for detachably securing said abrasive disk to the front face of said circular ring;
- said circular ring being stiffer than said foam pad so that the ring acts as a reinforcement means for the foam pad; and
- said circular ring being formed of a solid deformable stretchable material having a higher hardness and tensile strength than said foam pad, whereby said ring acts as a deformable container for said foam pad.

2. The sanding apparatus, as described in claim 1, wherein said circular ring has a rectangular cross-section;
- said circular ring having an inner annular surface and an outer annular surface; and
- the distance between the front surface of the circular ring and the front face of the support plate being greater than the distance between the inner and outer annular surfaces of the circular ring.

* * * * *